US005992202A

United States Patent [19]

Turley et al.

[11] Patent Number: 5,992,202

[45] Date of Patent: Nov. 30, 1999

[54] DRIVE SYSTEM FOR AXIAL ADJUSTMENT OF THE FIRST INTERMEDIATE ROLLS OF A 20-HIGH ROLLING MILL

[75] Inventors: John W. Turley, Oxford; Alexander Datzuk, Terryville, both of Conn.

[73] Assignee: T. Sendzimir, Inc., Waterbury, Conn.

[21] Appl. No.: 09/218,355

[22] Filed: Dec. 22, 1998

[51] Int. Cl.[6] ..... B21B 31/07

[52] U.S. Cl. ..... 72/247; 72/242.4

[58] Field of Search ..... 72/237, 238, 239, 72/245, 247, 248, 249, 242.4

[56] References Cited

U.S. PATENT DOCUMENTS

| | | | |
|---|---|---|---|
| 2,169,711 | 8/1939 | Sendzimir | 72/242.4 |
| 2,187,250 | 1/1940 | Sendzimir | 72/242.4 |
| 2,479,974 | 8/1949 | Sendzimir et al. | 72/242.4 |
| 2,776,586 | 1/1957 | Sendzimir | 72/242.4 |
| 4,289,013 | 9/1981 | Hunke | 72/243 |
| 4,805,433 | 2/1989 | Rennebaum | 72/247 |
| 5,131,252 | 7/1992 | Turley et al. | 72/242.4 |
| 5,666,844 | 9/1997 | Bieber | 72/242.4 |

*Primary Examiner*—Joseph J. Hail, III
*Assistant Examiner*—Ed Tolan
*Attorney, Agent, or Firm*—Frost & Jacobs LLP

[57] ABSTRACT

A drive assembly for axially adjusting at least one roll of the upper and lower pairs of first intermediate rolls of a cluster mill of the 20-high (1-2-3-4) type. The drive comprises a first horizontally oriented rack connected to one of the first intermediate rolls by a link and universal joint assembly. As least one idler gear, with its axis horizontally oriented, is meshed with the first rack. A second rack horizontally oriented is affixed to the piston of a horizontally oriented hydraulic cylinder. The second rack and the hydraulic cylinder are in parallel spaced relationship to the first rack. The second rack is meshed with the at least one idler gear so that axial movement of the piston and second rack in the hydraulic cylinder will result in axial movement of the first rack via the at least one idler gear to axially shift the at least one roll. Such a drive can have its first rack attached to a pair of rolls by a universal joint assembly and a link for each roll so that the drive can simultaneously axially shift both rolls. Four such drives can each be used to axially shift the four first intermediate rolls independently. In any of the embodiments the second rack may have a piston at both of its ends in its hydraulic cylinder so that the effective piston areas are the same in both directions of movement.

14 Claims, 9 Drawing Sheets

DRIVE SYSTEM FOR AXIAL ADJUSTMENT OF THE FIRST INTERMEDIATE ROLLS OF A 20-HIGH ROLLING MILL

TECHNICAL FIELD

The invention relates to the provision of an improved drive system for axial adjustment of the first intermediate rolls of a 20-high cluster mill of 1-2-3-4 construction, and more particularly to such a drive system which provides independent axial adjustment for all four of the first intermediate rolls, while providing easy access to the hydraulic cylinders of the drive system and equal axial adjustment force in both directions of motion.

BACKGROUND ART

This invention relates to 20-high cluster mills of 1-2-3-4 construction used for the cold rolling of metal strip. Mills of this general type are taught in U.S. Pat. Nos. 2,169,711; 2,187,250; 2,479,974; 2,776,586; and 4,289,013.

Existing methods of axial adjustment of the four first intermediate rolls operate by moving these rolls axially as pairs. One drive is used to adjust the upper two rolls together and a second drive is used to adjust the lower two rolls together. The upper two rolls have tapers at the operator side and the lower two rolls have tapers at the drive side, all four rolls being cylindrical in form, except for the taper at one side. For rolling, the start of the taper (i.e. intersection between tapered portion and cylindrical portion) is set close to the edge of the strip for best results. (i.e. to achieve the best strip flatness). As the width of the incoming strip changes from coil to coil, the tapered roll positions can be adjusted to suit, thus avoiding the necessity to change these rolls every time the strip width changes.

In U.S. Pat. No. 5,131,252, it was taught that improved strip profile control could be achieved by providing different profiles on all four first intermediate rolls and adjusting them axially individually, using four separate drives. Because of the restricted space in the area where these rolls are located, due to the fact that these rolls and their adjustment mechanisms are surrounded on all four sides by the six second intermediate rolls and the four drive spindles driving the four outer second intermediate rolls (known as the drive rolls), it is very difficult to fit four drives into the available space.

The present invention discloses a method for overcoming this difficulty, achieving four independent drives in the available space, with a rugged and easily maintainable construction.

DISCLOSURE OF THE INVENTION

According to the invention there is provided a drive assembly to axially adjusting at least one of the rolls of the upper and lower pairs of first intermediate rolls of a cluster mill of the 20-high (1-2-3-4) type. The drive comprises a first horizontally oriented rack connected to one of the first intermediate rolls by a link and universal joint assembly. At least one idler gear, with its axis horizontally oriented, is meshed with the first rack. A second rack is affixed to the piston of a horizontally oriented hydraulic cylinder. The second rack and the hydraulic cylinder are in parallel spaced relationship to the first rack. The second rack is also meshed with the at least one idler gear such that axial movement of the piston and second rack in the hydraulic cylinder will result in axial movement of the first rack via the at least one idler gear to axially shift the at least one first intermediate roll.

The drive just described can have its first rack operatively attached to an upper or lower pair of first intermediate rolls by a universal joint assembly and a link for each first intermediate roll. In such an instance, the single drive can simultaneously axially shift both rolls of the pair. A second similar drive can be provided for the other pair of the upper and lower pairs of first intermediate rolls so that the rolls of each pair are moved simultaneously by their respective drives and the upper and lower pairs can be moved independently.

Four such drives may be provided for the four first intermediate rolls so that each of the four intermediate rolls can be shifted axially, wholly independently of the other three first intermediate rolls. In all of the embodiments, it is preferred to provide the second rack of each drive with a piston at each of its ends. This assures that the effective piston area is the same in both directions of movement so that the force required to shift a roll is the same in either shifting direction.

DETAILED DESCRIPTION OF THE INVENTION

Figure 6:
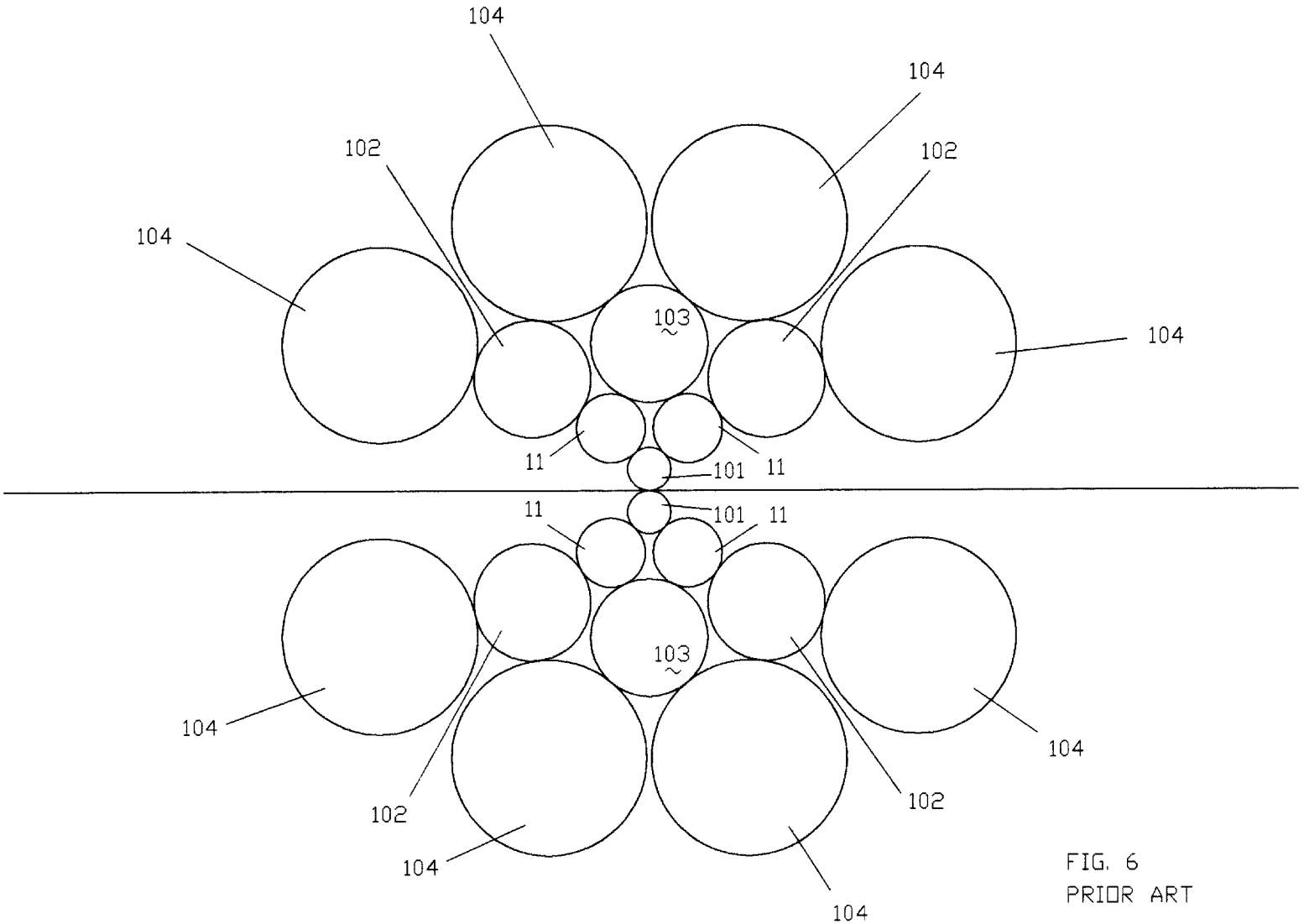
FIG. 6 PRIOR ART
FIG. 6 is a diagramatic representation of a 20-high cluster mill of the type to which this invention relates.

FIG. 6 diagrammatically shows the roll arrangement of a typical 20-high cluster mill to which this invention is applicable. Two upper and lower work rolls 101, between which the workpiece passes, are each backed up by two upper and lower sets of first intermediate rolls 11. The upper and lower sets of first intermediate rolls, in turn, are backed up by upper and lower sets of three second intermediate rolls, the center roll 103 of each set being a non-driven or an idler roll, and the two outer rolls 102 of each set being driven by drive spindles connecting them to a gearbox known as the pinion stand (not shown) which transmits the driving torque from an electric motor (not shown) to its four output shafts (not shown), which are each connected by a drive spindle (not shown) to one of the upper and lower drive rolls 102.

The upper and lower sets of three second intermediate rolls are supported by upper and lower sets of four backing assemblies 104, each backing assembly consisting of a row of caster bearings mounted on a shaft, the shaft being supported at intervals along its length by saddles, which in their turn are supported by the mill housing (not shown).

Figure 1:
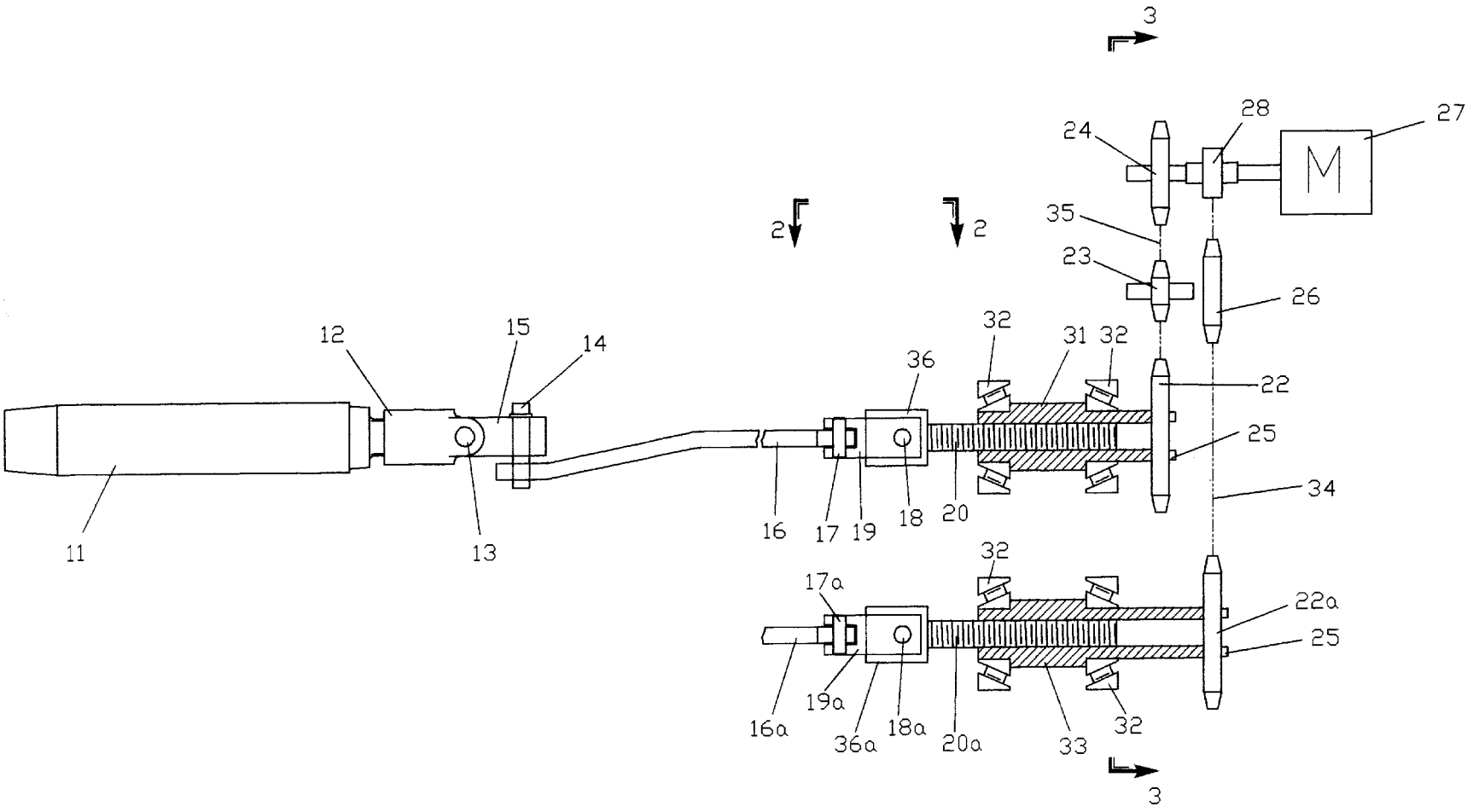
FIG. 1 PRIOR ART
FIG. 1 is a fragmentary longitudinal elevational view, partly in cross-section, of a prior art lateral adjustment drive of the screw/nut/chain type.
Figure 2:
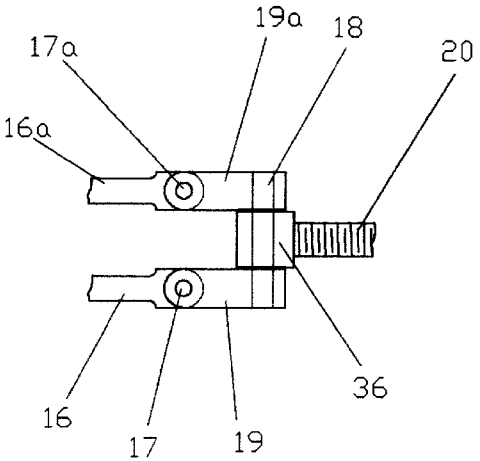
FIG. 2 PRIOR ART
FIG. 2 is a fragmentary plan view taken in the direction 2—2 of FIG. 1.

The present invention relates to the axial adjustment of first intermediate rolls 11. To better understand the present invention, it is believed that a brief discussion of prior art systems would be helpful. In FIG. 1, one prior art method for making such adjustments is shown. Roll 11 is provided with a non-rotating thrust bearing assembly 12, which is connected by a universal joint (consisting of horizontal pin 13, yoke 15 and vertical pin 14) to link 16. Link 16 is connected by another universal joint (consisting of vertical pin 17, yoke 19 and horizontal pin 18) to screw 20, as shown in FIG. 1. As shown in FIG. 2, a plan view, screw 20 is connected to two links 16 and 16*a*, because pin 18 engages both corresponding yokes 19 and 19*a*. Thus, one screw 20 provides the drive to both upper rolls 11, and a second screw 20*a* provides the drive to the lower two rolls 11 (not shown). The two screws 20 and 20*a* include bosses 36 and 36*a* at their ends through which pins 18 and 18*a* pass. Bosses 36 and 36*a* are also keyed to the drive housing (not shown) to prevent their rotation. Rotation of shaft 31 (upper) or shaft 33 (lower) on bearings 32 mounted in a fixed housing (not shown), these shafts being provided with an internal screw thread engaging with respective screws 20 and 20*a*, will cause the screws 20 and 20*a* and all connected parts including links 16 and 16*a* and rolls 11 to move in an axial direction.

The drive to shafts 32 and 33 (see also FIG. 3) is via motors 27 and 27A, couplings (one of which is shown at 28), drive sprockets 24 and 24*a*, chain 35 (upper) and chain 34 (lower), idler sprockets 23 (upper) and 26 (lower) to driven sprockets 22 and 22*a*, which are attached by screws 25 and 25*a* to shaft 31 (upper) or shaft 33 (lower). Shaft 33 is longer than shaft 31, enabling the chain and sprockets for the lower drive to be mounted in a different vertical plane from the chain and sprockets for the upper drive, so that the arrangement of FIG. 3 can be realized. Motor 27*a*, coupling 28 (not shown) and drive sprocket 24*a* for the lower drive are shown in FIG. 3 and are identical to the parts shown for the upper drive.

Figure 3:
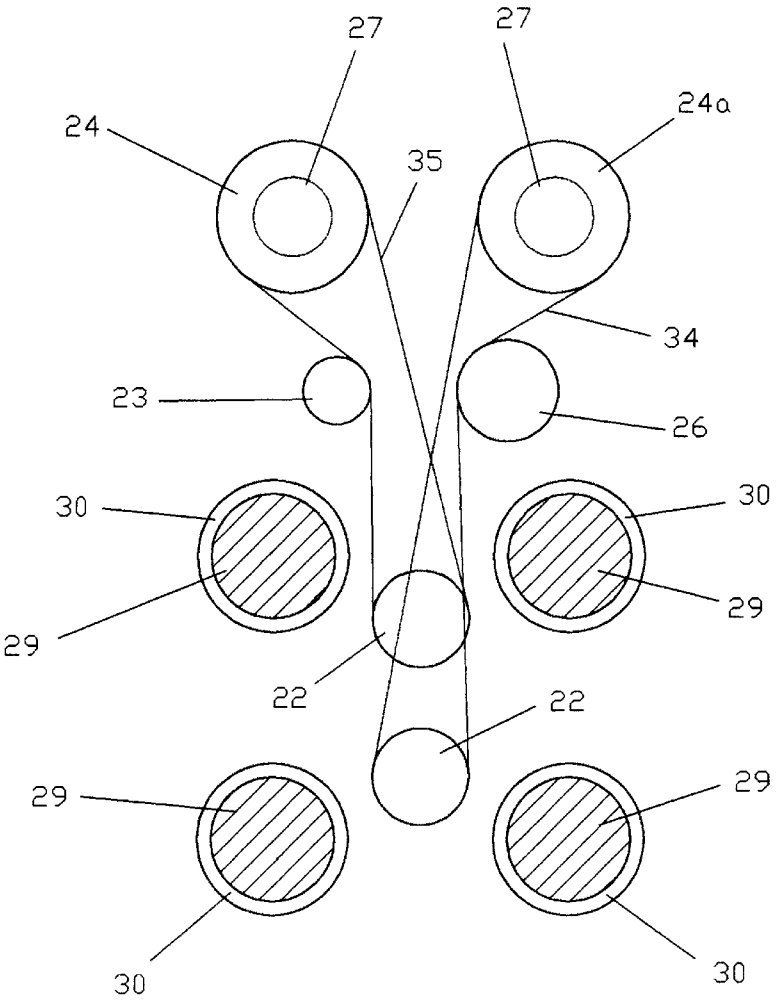
FIG. 3 PRIOR ART
FIG. 3 is a cross sectional view taken along section line 3—3 of FIG. 1.

In FIG. 3, drive spindles 29 and couplings 30 are shown. It can be seen how the function of idler sprockets 23 and 26 is to define the path of the respective chains 35 and 34 to fit the narrow gap between the two upper spindle/coupling assemblies 29–30.

It should be noted that the prior art adjustment drive system of FIGS. 1–3 is self locking. Thus, if motors 27 are not operated, the system will not "back drive"— this is ensured by the self-locking nature of a screw/nut due to thread friction.

Figure 5:
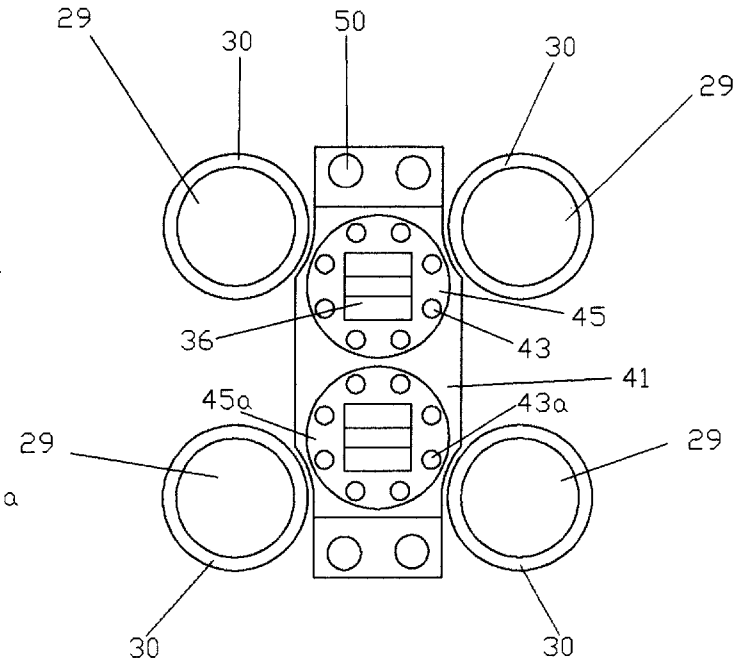
FIG. 5 PRIOR ART
FIG. 5 is a cross sectional view taken along section line 5—5 of FIG. 4.
Figure 4:
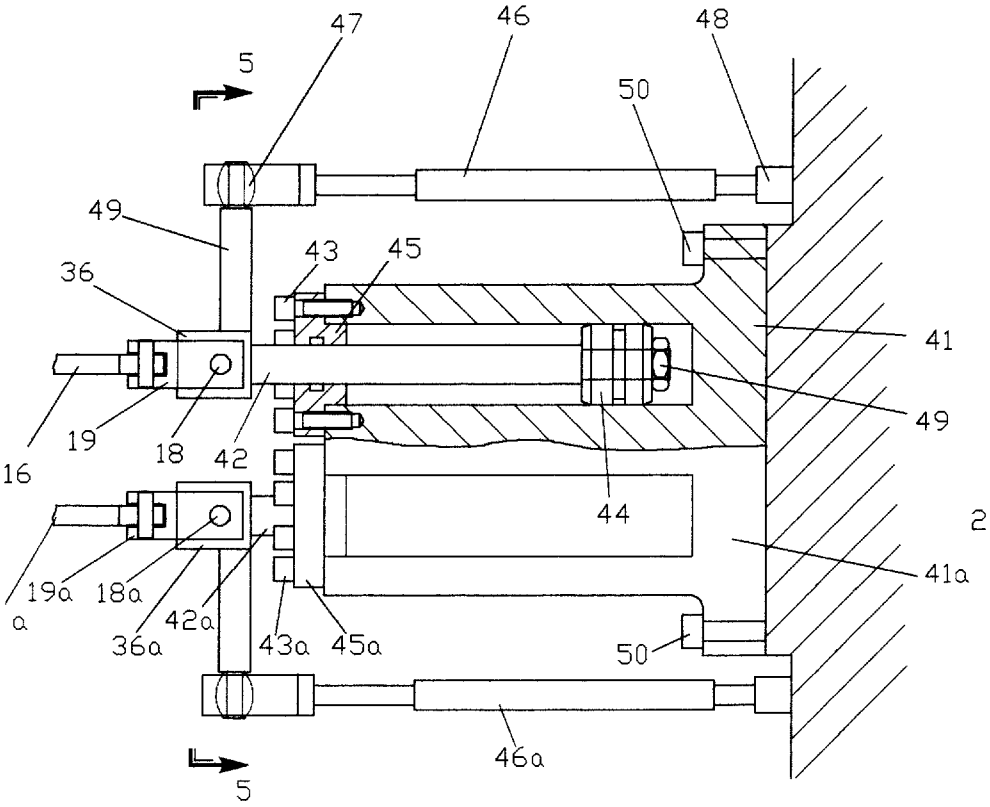
FIG. 4 PRIOR ART
FIG. 4 is a fragmentary longitudinal elevation, partly in cross section, of a prior art lateral adjustment drive of the hydraulic cylinder type.

In FIGS. 4 and 5, another prior art drive arrangement is shown. In this arrangement, the drive to link 16 is replaced by a hydraulic cylinder arrangement. Cylinder block 41 is provided with two cylindrical bores in which pistons are slideably mounted. One of the pistons is shown at 44. Piston rods 42 and 42*a*, attached to their respective pistons by screws (one of which is shown at 49), are provided with bosses 36 and 36*a*, respectively, identical to bosses 36 and 36*a* on screws 20 and 20*a* of FIG. 1. Thus, pins 18 and 18*a*, yokes 19 and 19*a*, pins 17 and 17*a*, and links 16 and 16*a*, can be connected to piston rods 42 and 42*a* in the same way that they were connected to screws 20 and 26*a*. Cylinder bores are provided with caps 45 and 45*a* attached to cylinder block 41 by screws 43 and 43*a*. Piston seals and piston rod seals are provided as is known in the art. Cylinder block 41 is bolted to the front face of the pinion stand by bolts 50. Oil is supplied to both ends of each cylinder bore via a hydraulic directional valve or servovalve (not shown). Thus, the piston 44 can be shifted in either direction, and such shifting will adjust links 16 and rolls 11 in the desired axial direction. The same is true of the lower piston. Since such a system is not self locking—a position transducer 46 is normally provided for piston 44. This is mounted on a stationary member such as the pinion stand by a mounting block 48, and its slide is coupled to the piston rod 42 (boss 36) via stand-off 49 and spherical rod eye 47. The output signal from this transducer is readily used for position readout and for providing position feedback if a closed loop position control loop is in operation. Similarly, a position transducer 46*a* can be provided for the lower piston in the same manner.

It should be noted from FIG. 5 that cylinder 41 has to be carefully shaped to fit in between spindles/couplings 29 and 30. Furthermore, the diameter of cylinder bore that can be achieved is limited by the available space so that it is necessary to operate the hydraulic system at very high pressure to achieve an adequate adjusting force. The same is true for the lower piston and cylinder. It should also be noted that the adjustment force when link 16 is in tension is smaller than the corresponding force when the link is in compression. This is due to diameter of piston rod 42 which reduces the effective area of the piston in the "retract" direction. Normally, since the diameter of rod 42 must be close to half that of piston 44, the force in the "retract" direction is only about 75% of that in the "extend" direction. The same is true for the lower piston and piston rod 42*a*.

The arrangement of FIGS. 4 and 5 is much simpler than that of FIGS. 1–3, and it should be more reliable and is certainly more responsive. However, it does have the disadvantage that if any problems arise with the hydraulic pistons or cylinder bores, then at least two sets of spindles and couplings must be removed in order to obtain access to cylinder 41. This necessitates removing all the rolls from the mill, and removing spindle safety guards (not shown) as well as the spindles, with the result that lost production time is of the order of 24 hours.

In FIGS. 7–14, one embodiment of the present invention is shown. The invention provides for independent individual axial adjustment of each of the four first intermediate rolls while providing for easy access to the hydraulic cylinders for maintenance or replacement, and also giving equal axial adjustment force in both directions of movement.

The embodiment provides complete symmetry about a horizontal plane at the level of the work piece (pass line), the drives to the upper two rolls being above the pass line, and the drives to the lower two rolls being inverted relative to the upper drives, and mounted below the pass line. Drive housing 75 is bolted and keyed to the front of pinion stand 77, using bolts 76 and key 103, and all the major drive components for upper and lower drives are mounted in or on this drive housing.

Figure 7:
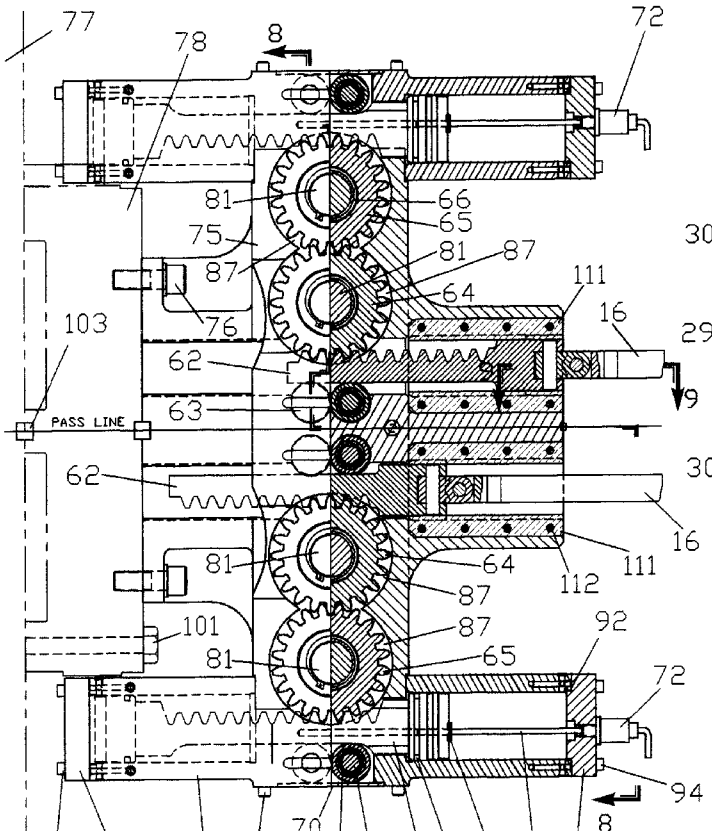
FIG. 7 is a longitudinal elevational view, partly in cross section, of a lateral adjustment drive according to the present invention.
Figure 9:
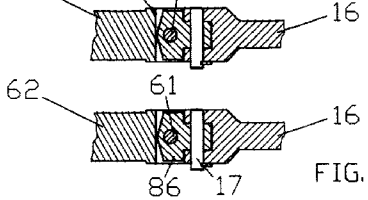
FIG. 9 is a fragmentary cross sectional view taken along section line 9—9 of FIG. 7.
Figure 11:
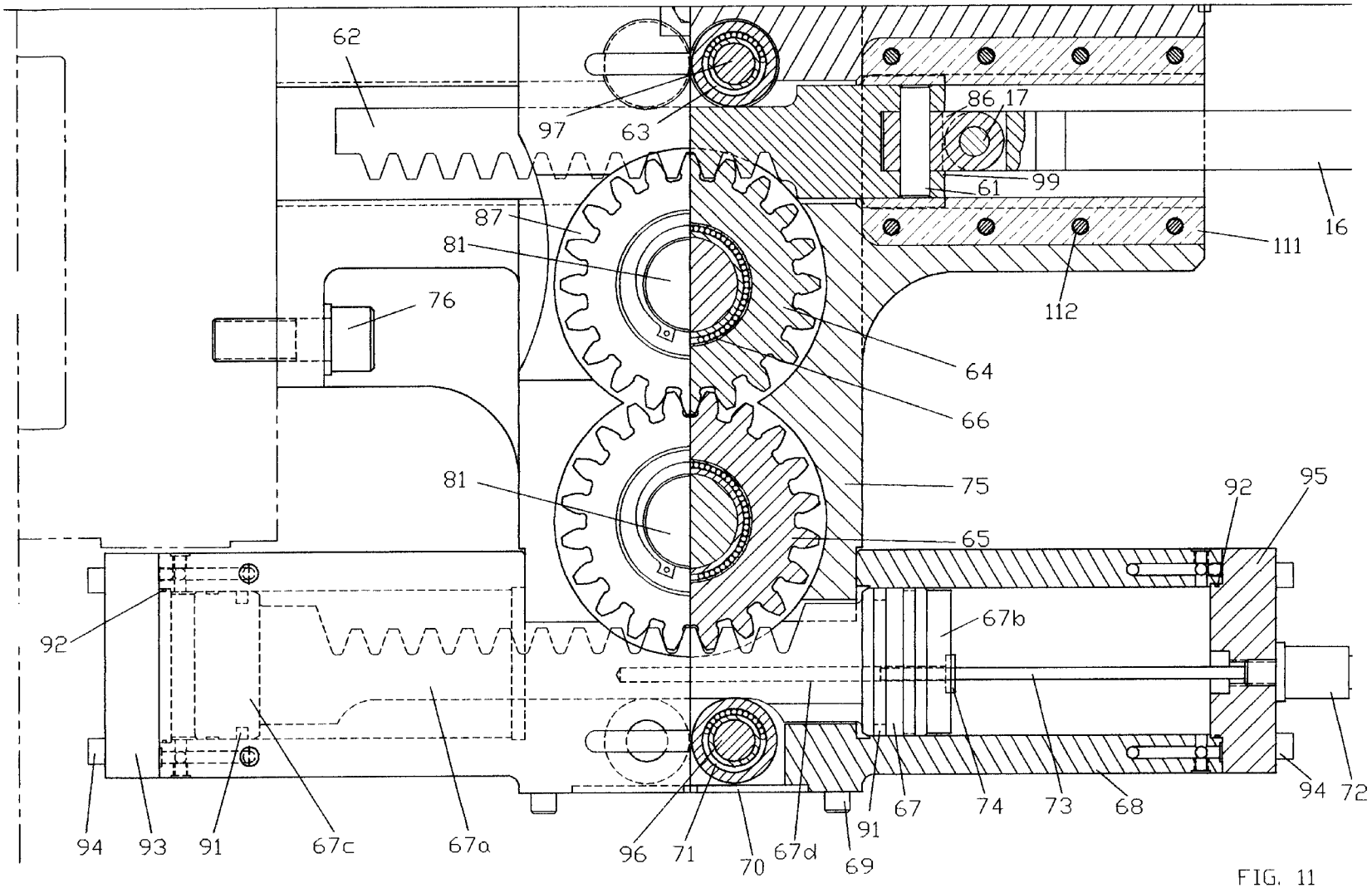
FIG. 11 is an enlarged view of the lower part of FIG. 7.
Figure 12:
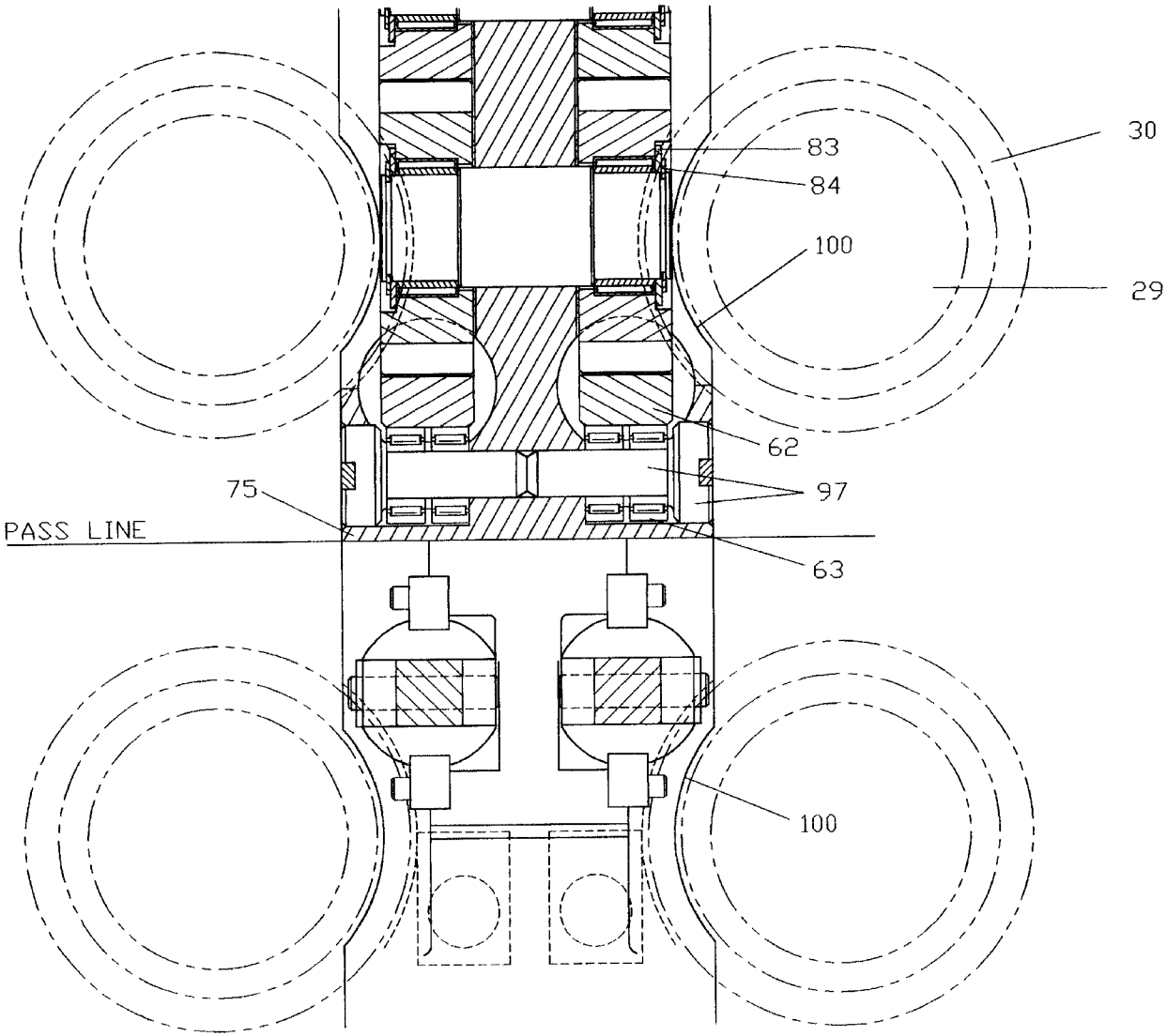
FIG. 12 is an enlarged view of the central part of FIG. 8.

As shown in FIGS. 9 and 11 each link 16 is connected to a gear rack 62 via horizontal pin 17, yoke 86, and vertical pin 61, said pins and yoke forming a universal joint. Gear rack 62 engages with inner idler gear 64, which engages with outer idler gear 65, which engages with combination piston-gear rack 67. The combination piston-gear rack is preferably of one-piece construction, but may be made in separate pieces joined together by fastening means such as screws. Combination piston-gear rack 67 consists of a central gear rack portion 67*a* and piston portions 67b and 67*c* in each end of which a seal 91 is mounted. In piston portin 67*b* and rack portion 67*a* a long hole 67*d* is provided through which sensing rod 73 of transducer 72 can pass, and at the same end magnet ring 74, whose position is sensed by the transducer 72, is mounted using screws (not shown). Combination piston-gear rack 67 slides within the bore of hydraulic cylinder 68, which is provided with a plain cap 93 at one end, and a cap 95 at the other end. Cap 95 is designed for mounting transducer 72. Both caps are mounted to the cylinder with screws 94, and sealed against the cylinder with seals 92, which may be the "O"-ring variety. Each cylinder 68 is mounted on drive housing 75 by bolts 69, and is recessed to locate it on the housing as shown in FIG. 7. Caster roller bearings 71 are mounted on pins 96 which engage in holes in each of the cylinder housings 68, and support the central gear rack portion of the combination piston-gear rack 67 (for each housing) against gear tooth separating forces, thus ensuring that its axis remains concentric with the axis of the bore of its respective cylinder 68. Cover 70 (see FIGS. 7 and 11) is provided to enclose caster roller bearings 71, and lubricating oil is supplied through a suitable hole in cover 70, to lubricate gears and bearings.

Figure 10:
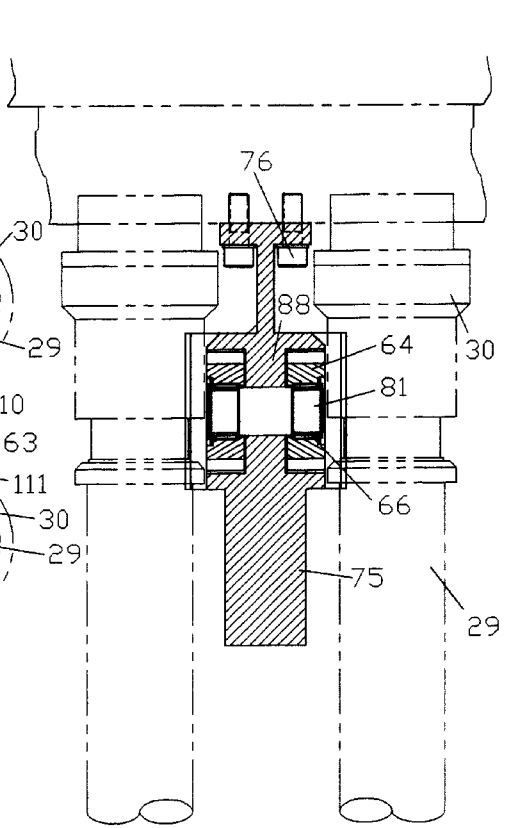
FIG. 10 is a fragmentary cross sectional view taken along section line 10—10 of FIG. 8.

Drive housing 75 is provided with eight counterbores 87 (four on each side) which overlap with each other and form a central rib 88 in the drive housing 75 (see FIG. 10). Four shafts 81 are pressed into bores concentric with the respective counterbores and extend into the counterbore area on each side. On each end of each shaft, bearings 68, idler gears 64 (inner shafts) and idler gears 65 (outer shafts) are mounted, then retainer plate 83 held on by snap ring 85, which retains the idler gear on the shaft (see FIG. 14). It is understood that either commercial roller bearings or sets of individual rollers may be used for shaft bearings 66.

Figure 13:
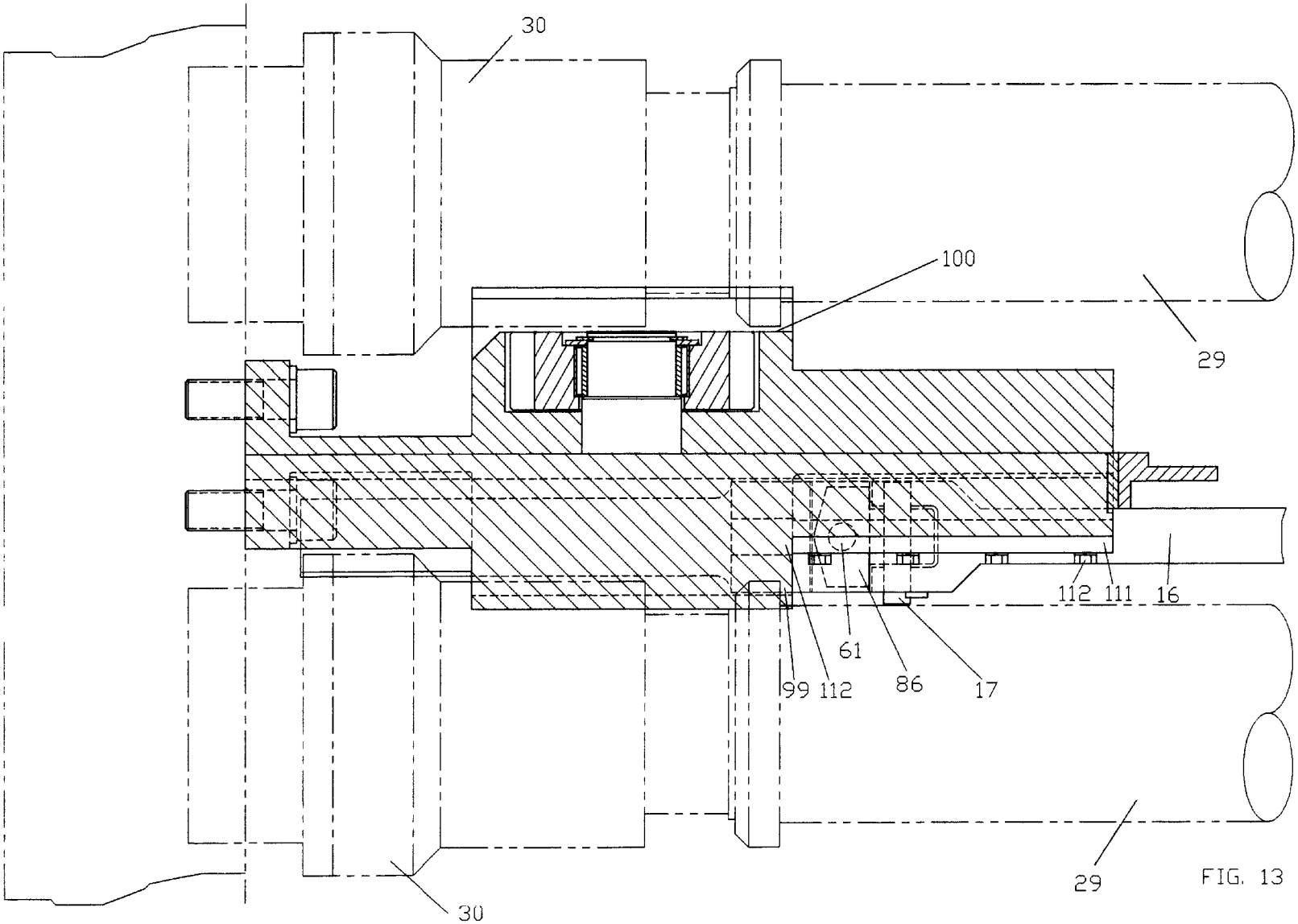
FIG. 13 is a fragmentary sectional view taken along section line 13—13 of FIG. 8.
Figure 14:
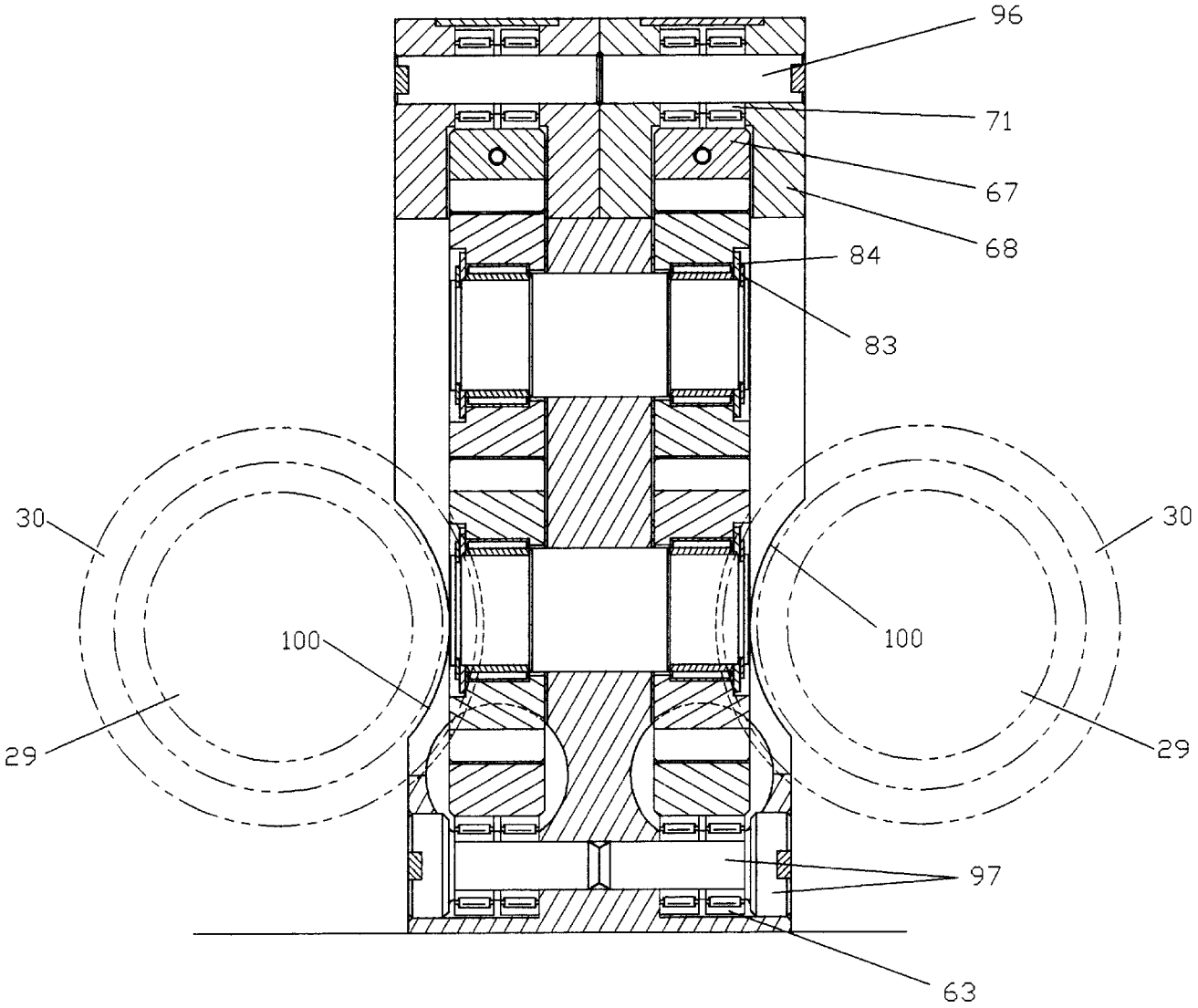
FIG. 14 is an enlarged view of the upper part of FIG. 8.

Caster roller bearings 63 (see FIGS. 8 and 12) mounted on shafts 97 which engage with holes in drive housing 75 are used to support each gear rack 62 against gear tooth separating forces. This arrangement also secures rack 62 and connecting parts 61, 86, 17 and 16 against rotation, but external keys 111 mounted to housing 75 using screws 112 and engaging with boss 99 (which is the part of rack 62 through which pin 61 passes) may additionally be used, as shown in FIGS. 11 and 13.

Figure 8:
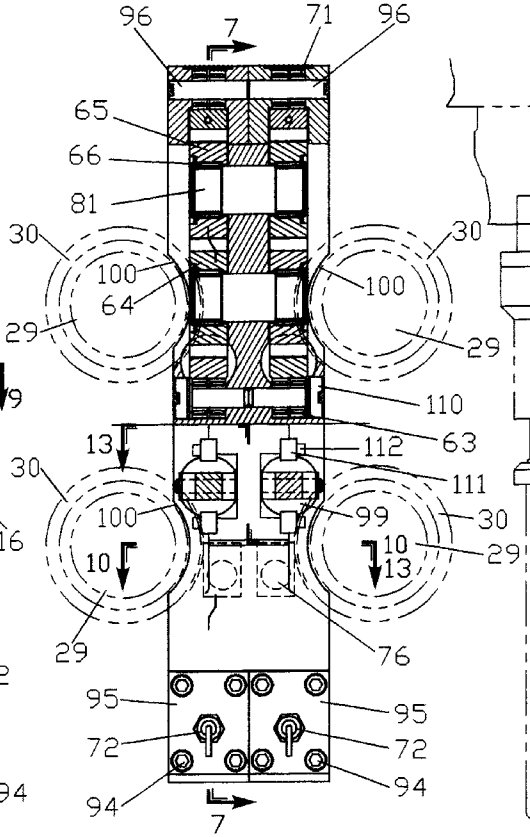
FIG. 8 is a transverse cross sectional view, partly in cross section, taken along section line 8—8 of FIG. 7.

In FIG. 8 it can be seen that recesses 100 are bored in the sides of drive housing 75 to enable drive spindles/couplings 29/30 to be cleared.

Each transducer 72 is of the magnetostrictive type, such as the "Temposonics" transducer marketed by M.T.S. Corp. of Research Triangle Park, N.C. Each transducer 72 is screwed into its respective cylinder cap 95 and sealed with an "O" ring. Its sensing rod 73 extends through an axial hole in combination-piston gear rack 67, and senses the position of magnet 74, mounted thereon. Other transducer types can be used within the scope of the invention.

FIGS. 7 and 8 also show nose-piece 78 which is attached to pinion stand 77 by bolts 101, and to which spindle safety guards (not shown) are mounted.

For very small mills where it may not be economic to provide the complete arrangement of FIGS. 7–9, it is possible to combine this concept with the prior art of FIGS. 4–6 by using a single drive of the type shown in FIGS. 7–9 to adjust the upper two rolls and another single drive to adjust the lower two rolls. This design would still retain the advantages of better accessibility to the hydraulic cylinder and equal adjustment force capability in both directions.

Modifications may be made in the invention without departing from the spirit of it.

The embodiments of the invention in which an exclusive property or privilege is claimed are:

1. A drive for axially shifting at least one of the four axially adjustable first intermediate rolls of a cluster mill of the 20-high (1-2-3-4) type, said drive comprising a drive housing, a first gear rack mounted in said drive housing and axially shiftable therein, a link, a first universal joint connecting said link to said first gear rack, a second universal joint connecting said link to said at least one first intermediate roll, at least one idler gear rotatively mounted within said drive housing and meshed with said first gear rack, a second gear rack parallel to said first gear rack with said at least one idler gear therebetween and meshed with said second gear rack, said second gear rack having first and second ends, a hydraulic cylinder affixed to said drive housing, said second gear rack being mounted in and axially shiftable in said cylinder, a first piston affixed to said first end of said gear rack, whereby axial movement of said piston and second gear rack in said hydraulic cylinder will cause corresponding axial movement of said first gear rack in said drive housing by virtue of said at least one idler gear, and axial shifting of said first gear rack will cause axial adjustment of said at least one first intermediate roll by virtue of said link and said first and second universal joints.

2. The structure claimed in claim 1 including a second piston affixed to said second end of said second gear rack, whereby the effective area on which the hydraulic fluid acts is the same for both directions of movement.

3. The structure claimed in claim 1 including first and second idler gears located in said housing, said first idler gear being meshed with said first gear rack, said second idler gear being meshed with said second rack, and said first and second idler gears being meshed together.

4. The structure claimed in claim 1 including a pass line for said mill, said four first intermediate rolls being arranged in a first upper pair above said pass line and a second lower pair below said pass line, said drive being arranged to shift the rolls of one of said pairs simultaneously and in the same axial direction, said first rack terminating in a universal joint assembly, a link for each first intermediate roll of said one of said pairs and joined thereto by additional universal joints, said links also being connected to said universal joint assembly of said first rack whereby shifting of said piston and second rack in said hydraulic cylinder will cause corresponding shifting of said first rack in said drive housing and shifting of said first rack will cause shifting of said first intermediate rolls of said one of said pairs by virtue of said universal joint assembly between said first rack and said links and said additional universal joints between said links and their respective first intermediate rolls.

5. The structure claimed in claim 4 including a second piston affixed to said second end of said second gear rack, whereby the effective area on which the hydraulic fluid acts is the same for both directions of movement.

6. The structure claimed in claim 4 including first and second idler gears located in said housing, said first idler gear being meshed with said first gear rack, said second idler gear being meshed with said second rack, and said first and second idler gears being meshed together.

7. The structure claimed in claim 4 constituting a first drive, a second drive identical to said first drive, said first drive being located above said pass line and being operatively connected to said upper pair of first intermediate rolls, said second drive being upside down with respect to the first drive, said second drive being located directly below said first drive and below said pass line, said second drive being operatively connected to said lower pair of first intermediate rolls, whereby said first drive will simultaneously shift said upper pair of first intermediate rolls and said second drive will shift said lower pair of first intermediate rolls.

8. The structure claimed in claim 7 including a second piston affixed to said second end of said second gear rack, whereby the effective area on which the hydraulic fluid acts is the same for both directions of movement.

9. The structure claimed in claim 7 including first and second idler gears located in said housing, said first idler gear being meshed with said first gear rack, said second idler gear being meshed with said second rack, and said first and second idler gears being meshed together.

10. The structure claimed in claim 7 wherein said drive housings for said first and second drives constitute a single, integral, one-piece structure, said first and second drives comprising a drive assembly.

11. The structure claimed in claim 1 including a pass line for said mill, said four first intermediate rolls being arranged in a first upper pair above said pass line and a second lower pair below said pass line, said drive comprising a first drive, second, third and fourth drives identical to said first drive, said first drive being connected by its first universal joint, link and second universal joint to one of said first intermediate rolls of said upp pair, said second, third and fourth drives being connected by their respective first universal joint, link, and second universal joint to the other of said intermediate roll of said upper pair and to said intermediate rolls of said lower pair respectively, each of said intermediate rolls of said upper and lower pairs being independently axially adjustable by its respective one of said first, second, third and fourth drives, said first and second drives being located above said pass line, said first and second drives being located side-by-side, said third and fourth drives being upside down with respect to said first and second drives, said third and fourth drives being located side-by-side and directly beneath said first and second drives.

12. The structure claimed in claim 11 including a second piston affixed to said second end of said second gear rack of each said drive whereby the effective area on which the hydraulic fluid acts is the same for both directions of movement.

13. The structure claimed in claim 11 including first and second idler gears located in each of said drive housings of said drives, said first idler gear being meshed with said first gear rack of its respective drive, each second idler gear being meshed with its respective second rack of its respective drive, each first idler gear being meshed with its respective second idler gear of its respective drive.

14. The structure claimed in claim 11 wherein said drive housings for said first, second, third and fourth drives constitute a single, one-piece, integral structure, said first, second, third and fourth drives comprising a drive assembly.

* * * * *